US005289665A

United States Patent [19]

Higgins

[11] Patent Number: 5,289,665

[45] Date of Patent: Mar. 1, 1994

[54] ORTHOGONAL FRAMEWORK FOR MODULAR BUILDING SYSTEMS

[76] Inventor: Gregory J. Higgins, 275 Greenwich St., New York, N.Y. 10007

[21] Appl. No.: 766,816

[22] Filed: Sep. 26, 1991

[51] Int. Cl.[5] ..... E04C 3/30

[52] U.S. Cl. ..... 52/721; 52/648.1; 403/173; 211/191

[58] Field of Search ..... 52/293, 296, 297, 299, 52/648, 646, 721; 403/173, 174, 178, 175, 170, 403; 182/179; 211/191, 192

[56] References Cited

U.S. PATENT DOCUMENTS

| | | | |
|---|---|---|---|
| 949,394 | 2/1910 | Daly | 403/173 |
| 3,392,947 | 7/1968 | Keliehor | 403/173 X |
| 3,769,772 | 11/1973 | Oetiker | 52/646 |
| 3,877,579 | 4/1975 | Weider | 403/178 X |
| 4,054,392 | 10/1977 | Oppenheim | 403/175 |
| 4,398,841 | 8/1983 | Kojima et al. | 403/173 |
| 4,577,449 | 3/1986 | Celli | 52/648 X |
| 4,904,108 | 2/1990 | Wendel | 403/173 |
| 5,022,209 | 6/1991 | Kimura | 403/173 X |
| 5,031,371 | 7/1991 | Davister | 403/170 X |

FOREIGN PATENT DOCUMENTS

| | | | |
|---|---|---|---|
| 2526890 | 11/1983 | France | 403/170 |
| 217537 | 8/1990 | Japan | 52/721 |

*Primary Examiner*—Carl D. Friedman
*Assistant Examiner*—Kien Nguyen
*Attorney, Agent, or Firm*—Fitzpatrick, Cella, Harper & Scinto

[57] ABSTRACT

A novel framework arrangement is presented whereby a bracket to shaft coupling assembly permits the face of horizontal beams to align with the face of a square tubular vertical posts and thereby establishes an exceptionally strong framework made up of exceptionally light structural elements (posts, beams and connector device) and comprising a minimum of interchangeable parts which can be readily mass-produced, and which can be used to assemble any variety of orthogonal building structure.

15 Claims, 17 Drawing Sheets

ORTHOGONAL FRAMEWORK FOR MODULAR BUILDING SYSTEMS

BACKGROUND OF THE INVENTION

The present invention relates to an orthogonal framework for building construction and in particular to a beam to column assembly comprised of a connection device and associated framework elements which permit a building to be erected and subsequently modified, added to, or dismantled swiftly using a minimum of interchangeable parts.

Space enclosure systems directed at rapid assembly of buildings of the orthogonal arrangement commonly take two forms: (1) assembly of load bearing panels, and (2) load bearing post and beam assemblies with infill panels, akin to properties of curtain wall construction in high-rise construction. The present invention pertains to this latter space enclosure type, i.e. posts and beams, especially of steel, for support of a variety of space enclosing means, especially infill panels of varying types and materials.

Within the post, beam and panel mode completely integrated systems of standardized parts to permit the manufacture of a minimum number of like elements which allow a maximum number of enclosure variations is problematic due to the need to integrate the modular measurement of the post and beam framework with the modular measurement of the panels.

A multitude of space enclosure systems exist which allow assembly of interconnecting parts to form a limited number of specific building types, shapes and sizes. Prior art systems include post and beam frameworks which are complete interconnecting systems but which require the integration of many assorted panel configurations of varying shapes, adding complexity to both the manufacturing task as well as in-situ assembly.

A multitude of connector assemblies have previously been proposed but none permits separate parallel beams to attach to posts, as in the present invention, such that beams can be added in any 90° degree or 180° degree direction for the support of both horizontal (floor, roof) and vertical (walls) infill means,, even after the initial or starter framework is assembled.

A comparison of FIG. 1 and FIG. 2, described in further detail later, identifies the major limitation to standardization and interchangeability of components (which has been called the "Great Problem of Standardization" by Heino Engel) as pertaining to building constructions of the post, beam and panel mode. That limitation is the conflict between center-to-center distance of structural elements, versus clear distance between structural elements, as seen in FIG. 1, and as shown resolved in FIG. 2.

Efficient manufacturing of space enclosure components is achieved when variations in dimension and shape are minimized. This optimization of size and shape is especially advantageous if the uniformity of the components does not limit the resulting size and shape of the desired end, i.e. a complete building unique to the intended use.

FIG. 1 shows in a most basic plan view that the common center-to-center alignment of posts 1 and beams 2 generates de facto a multitude of variations in the size and shape of panel elements that can be used with them. Horizontal (floor) panels 3 subdivided in three equal widths a necessarily create a different (wall) panel 4 subdivision width dimension b. In the configuration shown in FIG. 1 no equal subdivision of horizontal panels (generally floor or roof constructions) can equal any possible equal subdivision of vertical panels between posts (generally wall constructions). And when the distance between posts 2 is varied, e.g. to define two equal subdivisions a in spacing between beams 2 (at the right in FIG. 1) additional variations in equal subdivisions between posts is created as demonstrated by width c. Thus most common center-to-center post spacing creates a multitude of variations in widths of infill elements, which is not advantageous to the goal of efficient mass-production.

An alternative preferred beam arrangement face-to-face of the posts is disclosed in a most basic plan view in FIG. 2, wherein the space between posts measured from the faces of the posts results in infill panels of identical dimension a'. To achieve the inherent advantage of an equal number of widths for all infill panel elements, both horizontal and vertical, a double parallel beam arrangement is disclosed herein.

OBJECTS OF THE INVENTION

A primary object of the invention is to enable a building structure to be expanded or partially dismantled while not disrupting the structural or weathertight integrity of adjacent connected self-supported frameworks and infill means attached thereto.

A further object of the invention is to achieve a rapid building enclosure which can be easily erected and made weathertight before subsystems such as electrical, plumbing and ventilation parts are installed; this is made possible primarily by the dual beam arrangement joined to a suitably prepared hollow column thereby establishing an easily accessible means of vertical and horizontal distribution of utility subsystems.

Another object of the invention is to economize manufacturing costs by providing a framework of a minimum number of parts of uniform size and identical connecting means which can be used to construct a variety of building sizes and types, from simple small buildings such as small homes, to large structures such as skyscrapers.

Another object of the invention is to provide a structural framework composed of lightweight parts which can be erected straight and true by unskilled persons using common tools and generally available standard hardware, primarily simple nut and bolt fasteners and screws.

Another object of the invention is generally that the parts of the framework be of such size and weight that two persons can assemble these parts without the aid of special lifting equipment such as cranes.

Another object of the invention is to provide a means whereby a building framework can be assembled rapidly.

Another object of the invention is to provide a post or column to beam connector assembly which permits a varying number of horizontal beams to be employed in support of either floor or wall assemblies of varying materials, including wood, metal, glass, ceramic, and plastic.

Another object of the invention is to provide a building framework of high strength, and especially resistent to earthquake type forces, as is understood to be the case with properly secured and braced frameworks made of steel sections.

It is a primary object of the invention to provide a means of assembling structural frames whereby the space between vertical post or column members of equal square section can be subdivided in any number of equal modular increments for all horizontal and vertical infill elements (such as floor, roof and wall panels), independent of the cross-sectional area of the square vertical structural element.

Yet another object of the invention is to provide a building framework having a contiguous space between posts thereby providing a means to locate building utility elements such as pipes, ducts, wires and similar devices for both horizontal and vertical distribution throughout the assembled structure.

It is another object of the invention to interchange the location of end beams, which carry the loads of secondary structural elements such as infill panels or wood joists, with tie beams which parallel secondary structural elements and act to laterally brace and tie posts to one another. The interchangeability of end beam positioning with tie beam positioning permits the structural orientation or direction of span of floor or roof infill elements to assume any right angle plan view orientation.

It is another primary object of the invention to provide support for horizontal infill elements,, such as floor or roof panels, of a predetermined square feet area, to be structurally independent of the adjacent predetermined plan view square feet area or areas, so that additional structurally independent horizontal infill elements can be co-aligned and expand the overall horizontal square feet area of the structure, such that the overall plan view square feet area can be increased or decreased as desired without necessarily disrupting adjacent areas.

Another object of the invention is to provide an orthogonal framework for custom mass produced toy buildings of the post, beam and panel type, whereby all disclosed properties herein apply except that the relative scale of all components is adjusted for use by children for toy building constructions, or by any person for scale model building construction such as doll houses.

SUMMARY OF THE INVENTION

In accordance with an aspect of the invention, a novel connecting device is provided which permits vertical posts to be coupled from above and below, and which permits U-shaped demountable beam connection brackets to be attached to the connecting device in such a manner that floor and wall loads supported by beams are transferred to the posts independent of adjacent infill structural means such as walls, roof and floor panels. The resulting double parallel beam configuration allows similar beams to support floor or roof structures of any depth as well as wall structures of thickness equal to the width of square posts so that additional floor or wall structures can be added to the first framework in any direction, and without necessarily disrupting the first or starter framework.

The framework of the invention is intended to be made of steel, with coupling means of welding and various bolting arrangements, including lightweight rolled sheet steel structural sections suitable for self-tapping screw-type fastening devices.

The present invention pertains specifically to rapid assembly of posts and beams for the purpose of supporting varying types of infill panels so that a weathertight building shell ready to receive in-situ conventional electrical, mechanical and finish items can be rapidly assembled. The framework could alternatively be useful in constructing modular racks or shelving.

More specifically, a novel connector part of the invention unites suitably prepared posts and beams in a manner permitting optimal variations in building framework and is capable of providing supporting means for a variety of interchangeable panel types which may or may not incorporate doors, windows, stair openings or similar functional sub-elements, all capable of being expanded or disassembled and reused.

In a preferred embodiment of the invention a hollow square tube or shaft is provided to which vertically aligned hollow posts can be connected. The tube has U-shaped brackets mounted thereon providing dual flanges, one at each face of the shaft, so as to receive generally horizontal beams connected thereto, such that the face of the beams aligns generally with the face of the shaft. The arrangement results in an intersection of eight beams at the interior post of the framework; four beams at the perimeter side location of the framework; and two beams at the outside corner post of the framework. Vertical space enclosing infill elements such as wall panels of thickness equal to the width of the square posts or columns are supported by beams which are identical or of similar type as beams supporting horizontal infill elements such as floor panels. The beam participating in supporting floor elements is independent of the beam supporting wall elements, and the beam supporting wall elements can be readily repositioned to support horizontal infill elements, and are thus interchangeable. The post, beam and infill panel elements can be added to the initial or starter framework ad infinitum in orthogonal arrangement horizontally in any direction, and upwards in orthogonal arrangement vertically from the first foundation supported framework to any reasonable height.

It is understood that the transfer of all forces (loads) through the framework for reaction with the earth by means of a foundation is obvious and not part of or necessary to understanding this invention.

The above and other objects, features and advantages of the present invention will be apparent to those skilled in the art in the following detailed description of an illustrative embodiment thereof, wherein:

DESCRIPTION OF THE PREFERRED EMBODIMENTS

Figure 1:
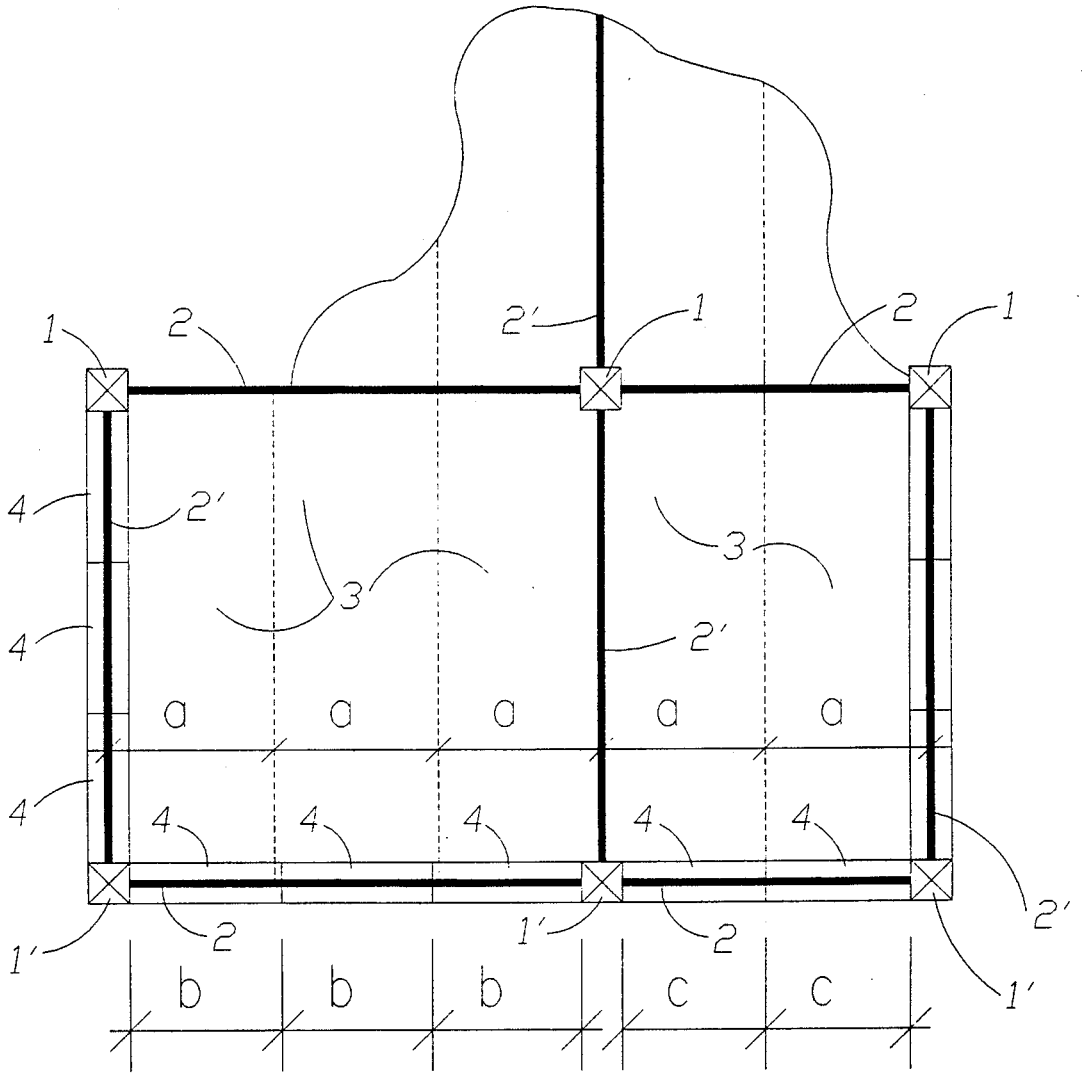
FIG. 1 (PRIOR ART)
FIG. 1 is a fragmentary schematic plan view illustrating a common arrangement of building post and beam structures.

FIG. 1 illustrates in most basic plan view the variations in width which occur in panel type infill means between posts in a typical orthogonal framework where the modular distance between posts is measured from the centerline of the posts which corresponds to the centerline of the beams. In FIG. 1 the region between the three parallel bold lines 2' representing the beam centerlines is subdivided into five equal measurements a, composed of a square region of three equal dimensions a and an adjacent rectangular region of two equal subdivisions, also of the same width a. These five equal subdivisions represent one of many possible equal width subdivisions of mostly horizontal floor and/or roof panel type infill 3 between supporting beams in conventional construction.

In diagram FIG. 1 all beams 2 and 2' are supported in orthogonal arrangement by square posts 1 and 1' of equal size; with the distance between the faces of perimeter posts 1' being subdivided into equal modular measurements b and c representing equal widths of mostly vertical wall panel type infill means 4 between face of posts; and the wall panel means are equal in depth to the width of the posts.

FIG. 1 therefore illustrates that given an orthogonal framework of posts, beams and infill means, generally panels, at least one variation in the width of infill means must occur, and that such a variation is caused by the width of the post displacing the distance occurring between face of posts, but not occurring between the centerlines of beams. And it is further illustrated in FIG. 1 that any variation in beam length as a multiple of infill means width a necessarily generates another third variation c in modular measurement wall panel width.

An essential goal to economical mass production is the need to minimize variations in the size of pieces assembled to create a final end product; in the present case, a building construction.

Figure 2:
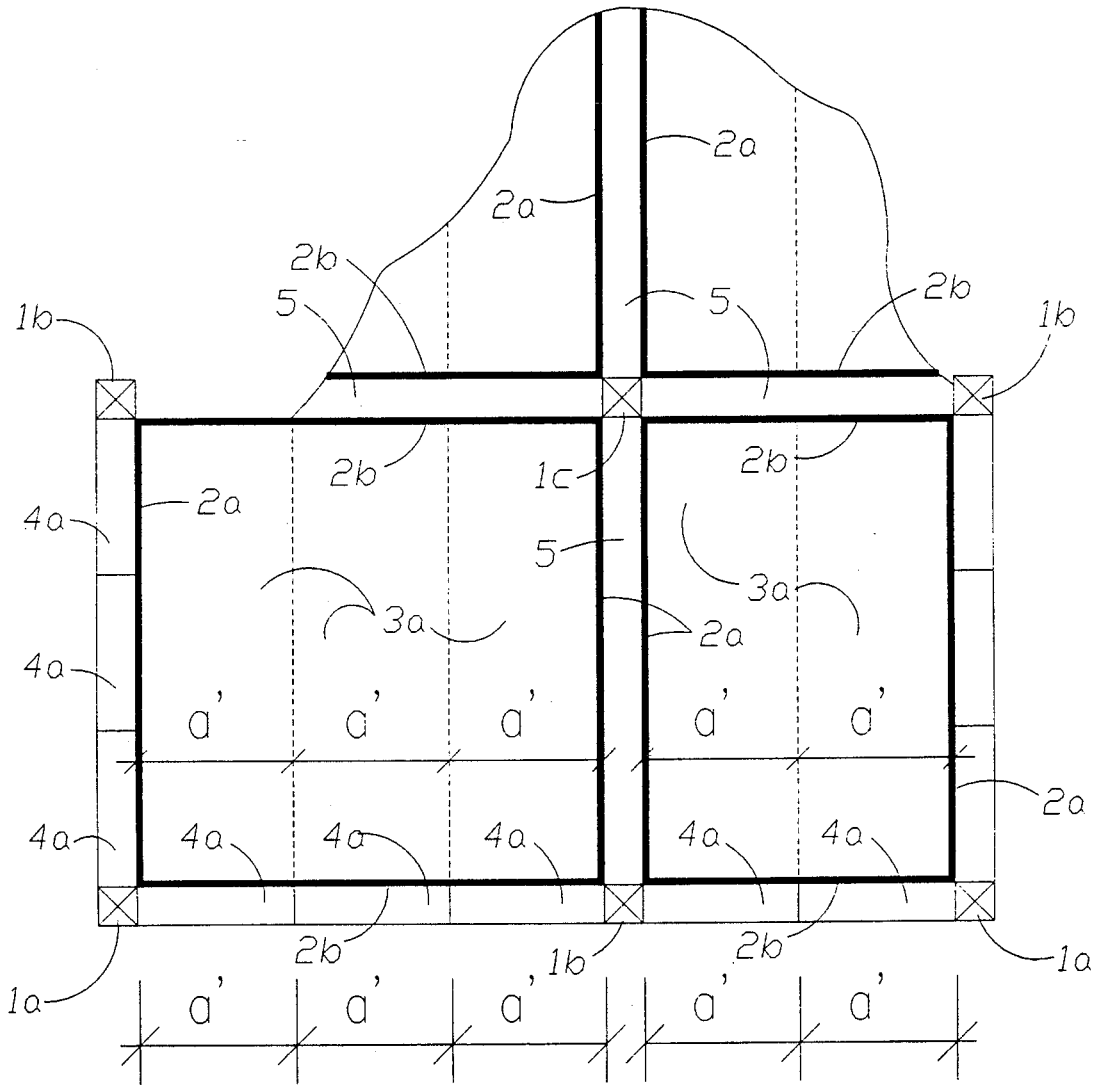
FIG. 2 is a fragmentary schematic plan view illustrating the novel arrangement of building post and beam structure of the invention wherein the beam faces align with the face of the posts rather than with the center of posts.

The preferred arrangement shown in diagram FIG. 2 addresses the problem of the multiplicity of panel widths occurring in the prior art arrangement of FIG. 1 by aligning beams 2*a* and 2*b* with the face of square post 1*a*, located at the outside corner of the most basic orthogonal framework, and posts 1*b*, located between panel regions at the framework perimeter, and at post location 1*c*, located at the interior location of the framework. The length of supporting beams 2*a* and 2*b* therefore correspond to any given multiple of equal subdivision a', but in this case dimension a' remains the same for both horizontal (floor/roof) and vertical (wall) panel infill means. Thus it will be seen that an orthogonal framework of posts and beams of any size can be created whereby all panel means 4*a* are of the same width corresponding to beams of a length equal to any multiple unit subdivision of the distance between face-of-post to face-of-post.

Further vertical panel infill means of equal width, generally wall elements which may incorporate doors, windows or other devices associated with building enclosures, could be interchanged with one another to permit broad flexibility in building design. The same is true for variations in horizontal floor or roof panel infill means, such as openings for stairways, balconies or skylights.

As also illustrated in FIG. 2 a gap 5 results from preferred beam positioning from post face to post face which occurs between the parallel beams intersecting at adjacent corners of the same post face. The gap 5 will be shown in the preferred embodiment of the present invention to provide a route for the introduction of common building service utilities and services, such as water, fuel, and waste piping and electric wires and cables.

Further the equal width of all panel infill means, vertical and horizontal, greatly simplifies mass production in the factory by minimizing jig types and sizes, and facilitates close packing of like-sized infill means for efficient transporting. It is also advantageous in the present invention that the double parallel beam arrangement at the post face enhances the structural rigidity of the framework, and by dividing gravity loads into two beams instead of one the weight of each beam is reduced for ease of assembly.

The primary purpose of the present invention is to provide a system of framework elements to achieve the goal of a minimal number of parts as illustrated in diagram FIG. 2 that can achieve a maximum of building sizes and types.

Figure 3:
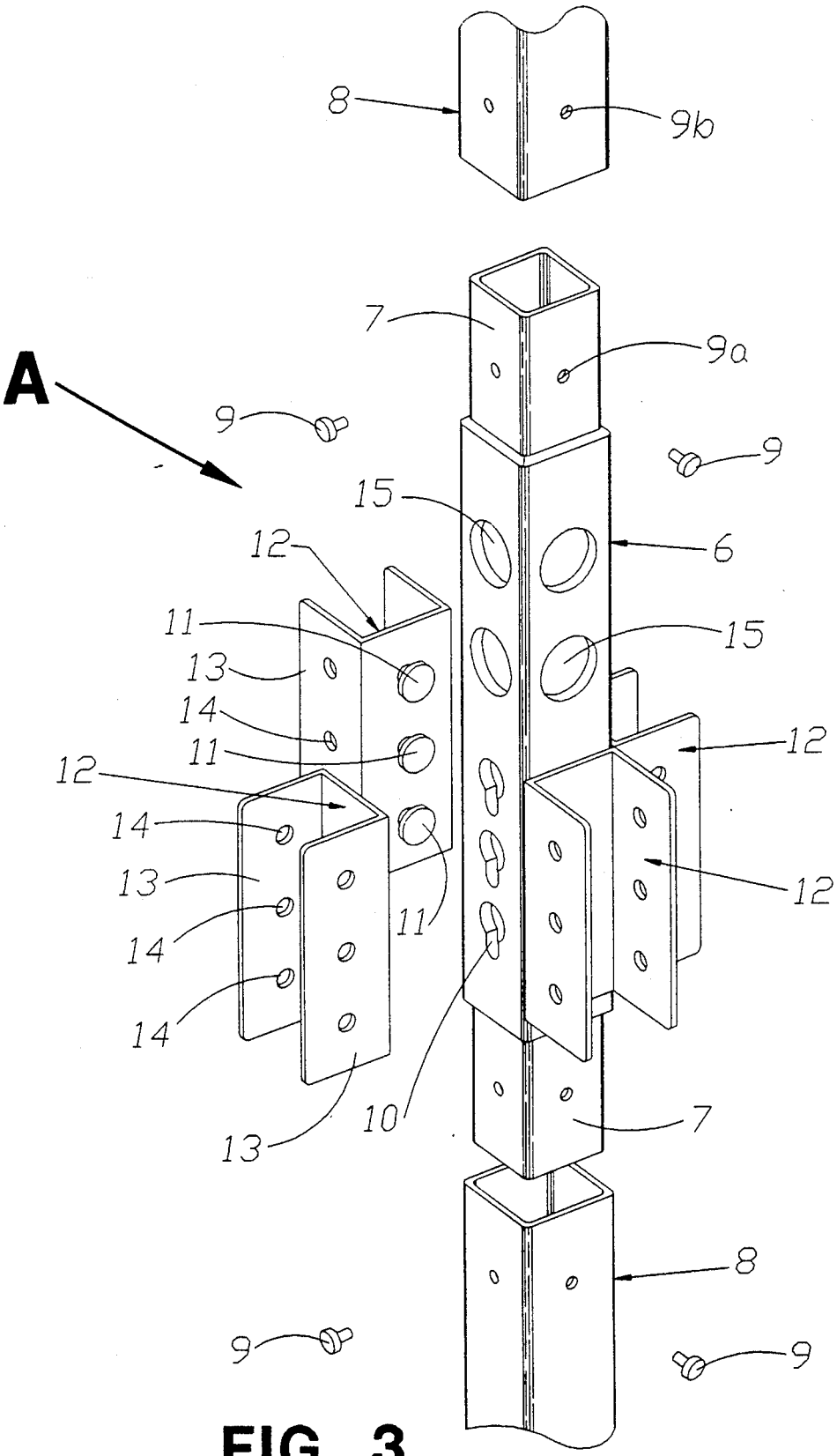
FIG. 3 is a partially exploded isometric view of the present invention.

Post and beams of the most basic building framework shown in plan view in FIG. 2 are united by a connecting device A seen in isometric view in FIG. 3. As seen therein a vertically oriented square tubular shaft body 6 is provided which has sleeve extensions 7 projecting at top and bottom. These extensions have the identical cross-sectional shape as the interior of shaft or tube 6. Each side of sleeve element 7 is less than the width of each face of larger tube shaft 6 such that a portion of sleeve 7 fits tightly inside tube shaft 6 and is welded integral to it. Connecting shaft 6, with integral welded to downward and upward projecting sleeves 7, is therefore ready to receive post members 8. These posts are hollow tubes of identical cross-section as connecting tubular shaft 6 and therefore can be slidably engaged over the sleeve to the connecting shaft 6 from above and below.

The posts a are secured to sleeves 7 by means of a friction fit pin 9 or the like. Sleeves 7 and shaft 8 share coaligned holes 9*a* and 9*b* so that when the sleeves are engaged in the posts tightly fitting pin 9 can be inserted to hold the posts rigidly connected to the primary connecting device 6. While the pins are the presently preferred method of forming this locking engagement, other common means may be used, such as bolts, screws or rivets.

Connecting assembly shaft 6 further includes a plurality of vertically aligned key-hole shaped holes 10 formed therein along the vertical centerline of each face of the square tube (one face is shown in FIG. 3, but the same condition exists at the three other sides of the tube). Key-holes 10 are suitably sized to receive three vertically aligned equal spaced flared studs 11 attached by preferred plug welding means to a three sided or U-shaped bracket 12, illustrated in FIG. 3 at adjacent 90° positioning and opposite 180° positioning. It is readily understood that from one to four identical U-shaped brackets can be engaged face-of-bracket to face-of-tube, and with the side of bracket aligned flush to the side of the tube, at any one of four sides of the connecting tube. Also, each face of the four brackets likewise co-align flush with the face of engaged post elements of the framework.

As also illustrated in FIG. 3, large diameter holes 15 are formed in shaft 6, two at each of its four faces. Holes 15 are aligned along the vertical centerline of the tube post assembly and are situated centrally in the region of the tube face between the top of an engaged bracket 12 and the top of shaft 6. The large diameter holes provide an opening in the completed assembly for the introduction of wire or piping devices typically associated with building constructions, which can be distributed vertically upwards or downwards by means of the hollow connecting assembly engaged with the hollow structural posts.

The main square tubular body 6 of the connecting assembly, the integral tubular splicing shafts or sleeves 7, and the tubular posts 8 are, for economy of construction reasons, preferably composed of common tubular steel material of suitable size and wall thickness to carry loads depending on the size of the completed construction. It is integral to the objects of this invention that the cross-sectional area of all square tubular vertical elements and the corresponding width of the U-shape bracket can be increased and decreased in size independent of all other elements of the framework such as the beams shown in FIG. 4 or the infill elements such as floor, roof or wall panels to be discussed in connection with FIGS. 8, 9, 10, 11, 14. This allows identical beam and infill members to be used in all variations in vertical post cross-sectional area and tube wall thickness desired to carry gravity loads as a function of final building size. This is extremely advantageous for economical mass-production.

It is essential to appreciate that the flanges 13 of the U-shaped bracket 12 align flush with the face of each side of the square tubular connecting device 6 which is also aligned flush with the engaged tubular post elements 8. This structure allows orthogonal distances from face-to-face of other adjacent connecting assemblies to be equal in all four 90° directions so that the distance is the same for infill elements such as a panel or panels and for the beams which shall be shown later to support infill elements by suitable connection to the bracket flange 13.

Figure 4:
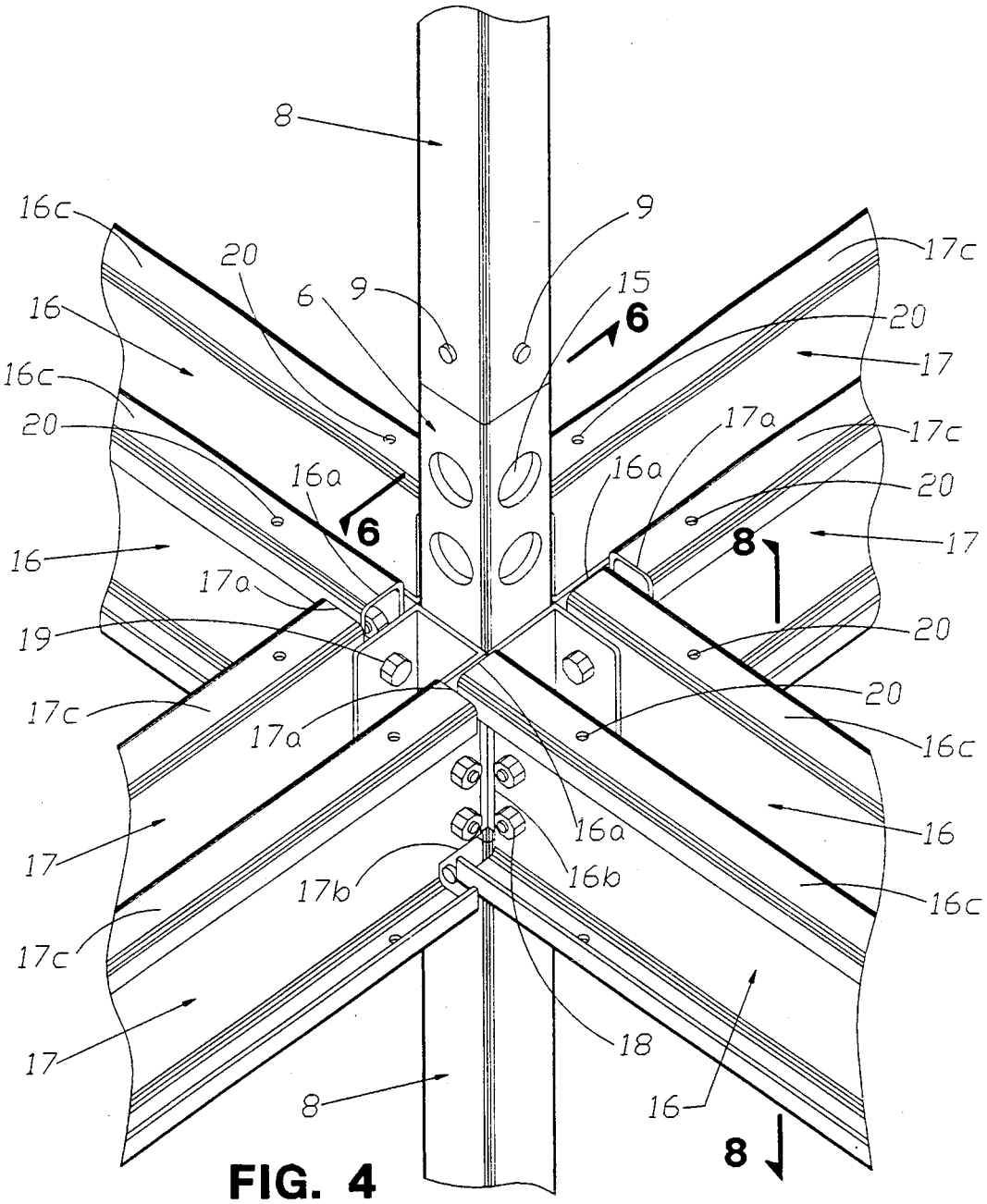
FIG. 4 is an isometric view of the present invention illustrating the positioning of tie beams and ends beams to the connector device.
Figure 8:
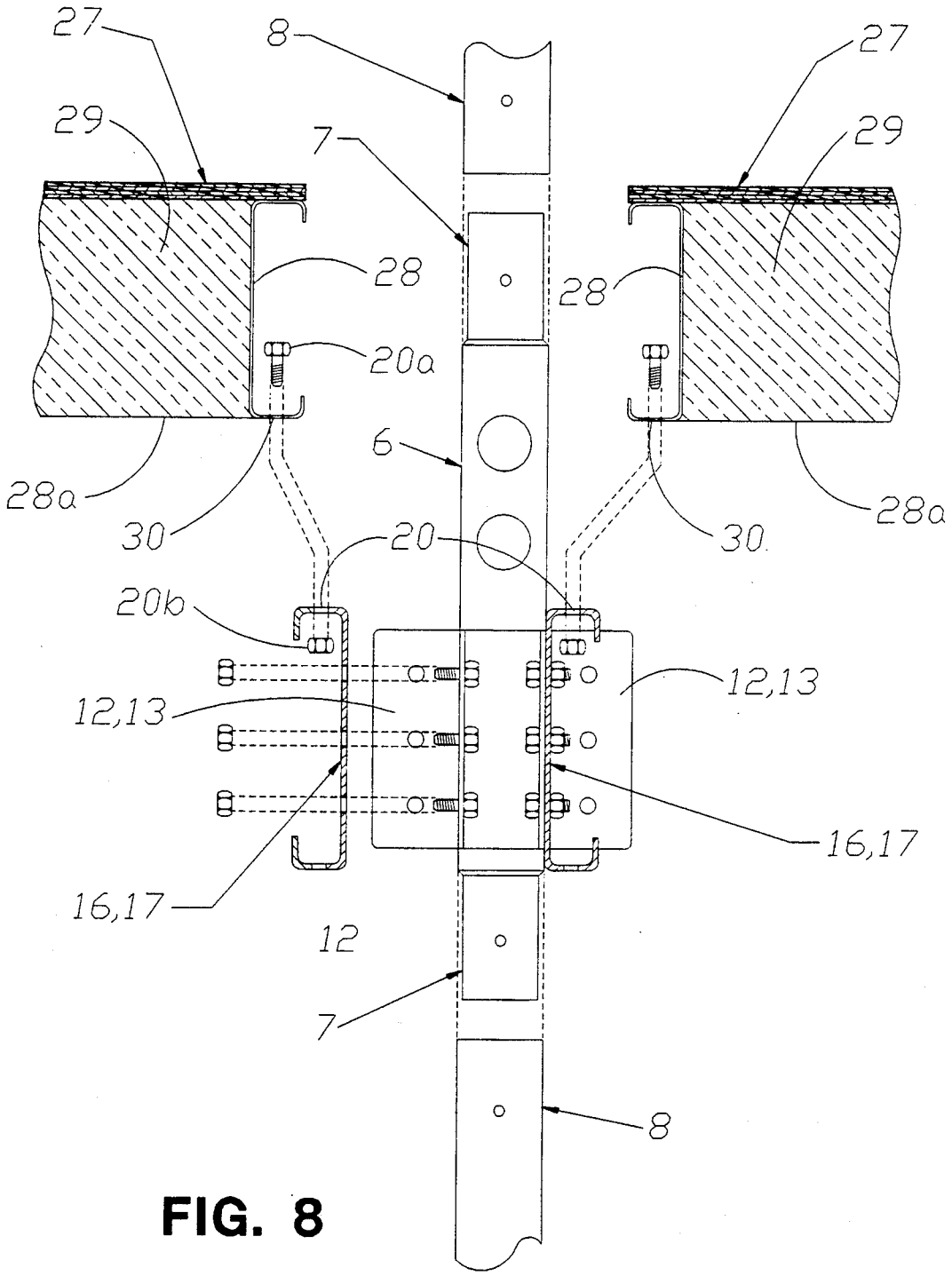
FIG. 8 is a partially exploded vertical section view taken along line 8—8 of FIG. 4 illustrating the relative positioning of typical components in advance of completed assembly at the typical interior post condition.

FIG. 4 is of the same isometric viewpoint as FIG. 3, but illustrates the horizontally positioned beams 16 and 17 arranged perpendicular to each face of the tubular connecting shaft 6. These beams are generally channel shaped as shown in FIG. 8 and are connected to the flanges 13 with nuts 18 and bolts 19 so that the flat inwardly facing surface of each beam's web is aligned flush with each of the four faces of the square tube.

FIG. 4 illustrates a typical intersection of eight beams which occurs at the interior post location 1*c* of the orthogonal framework shown in FIG. 2. Other beam to bracket arrangements using identical elements for corner post locations 1*a*, and side location 1*b*, shown in diagram FIG. 21 would be of the same construction except that one or two of the brackets 12 would be eliminated. Therefore these configurations are not shown.

Referring again to FIG. 3 and FIG. 41 the Unshaped brackets are attached in sequence first to the connecting tube 6 via the studs 11 inserted in the corresponding key-hole type openings 10. Then a beam 16 is attached by common bolting means 18, 19 using corresponding predrilled vertically aligned bolt holes 14 in the bracket and in the beam. Conversely, it is integral to the preferred embodiment that the assembly sequence can be readily reversed, and any or all bracket-to-beam assembly and bracket-to-connecting tube assembly can be demounted in any sequence. Other features of the preferred embodiment further illustrated in FIG. 4 are the pins 9 in friction forced-in position securing post 8 to sleeve 7, and the predrilled holes 20 in the top flanges of beams 16, 17 for common nut/bolt type fastening with infill panel elements illustrated later in FIGS. 8, 9, 11 and 12.

Although the channel-type beams 16 and 17 are similar, it is seen in FIG. 4, that the top and bottom flanges of beams 17 are set back at location 17*a*, 17*b* from the face of square tube 6 by the width of beam flange 16*c*, so that the beams join at right angle adjacency at the post corner. Further, the side of each beam set against and bolted to the Unshaped bracket, is therefore aligned flush with each face of the square connecting tube 6 and by extension also with post 8.

For interchangeability and ease of assembly during construction both the end beams 16 and tie beams 17 intersect at right angle to each other at separate 90° opposing U-shaped brackets, thus enabling beams and brackets to be added to the framework, or conversely removed, without disrupting adjacent 90° dual beam constructions, or adjacent parallel opposite faces of post 8 dual beam elements and associated brackets.

Further for economy and interchangeability of construction, each of the two beam types 16 and 17 are identical in depth such that their horizontal faces top and bottom, 90° adjacent and opposite parallel beam flanges 17c and 16c align flush with each other to provide a flat level surface for supporting generally flat horizontal infill elements, such as roof or floor panels, or individual secondary members, such as common wood or steel joists.

PIG. 5 is a partial section cutaway view of the fully assembled connection between the beam bracket 12 and the wall of the connecting tube 6 and between the post 8 and sleeve 7 secured by pin 9. Each of the four sidewalls of the tube 6 are provided with a plurality of vertically spaced key-hole type openings 10 at the centerline of the face, co-aligned for slotted engagement with flanged studs 11 welded or otherwise combined structurally with the beam bracket 12. The studs 11 are preferably solid metal protrusions profiled with flared ends of a diameter slightly less than the upper larger diameter portion 10a of the key-hole and a slightly less diameter at the stud base than the lower portion 10b of the key-hole, so that bracket 12 can be held in place supported by the studs engaged into the slotted holes after being dropped vertically downward to establish a reasonably locked and structurally sound positioning with strong resistance to downward and rotational forces. Other obvious suitable means of engagement between the bracket and connecting tube 6 are bolts,, screws or similar commonly available means.

Figure 5:
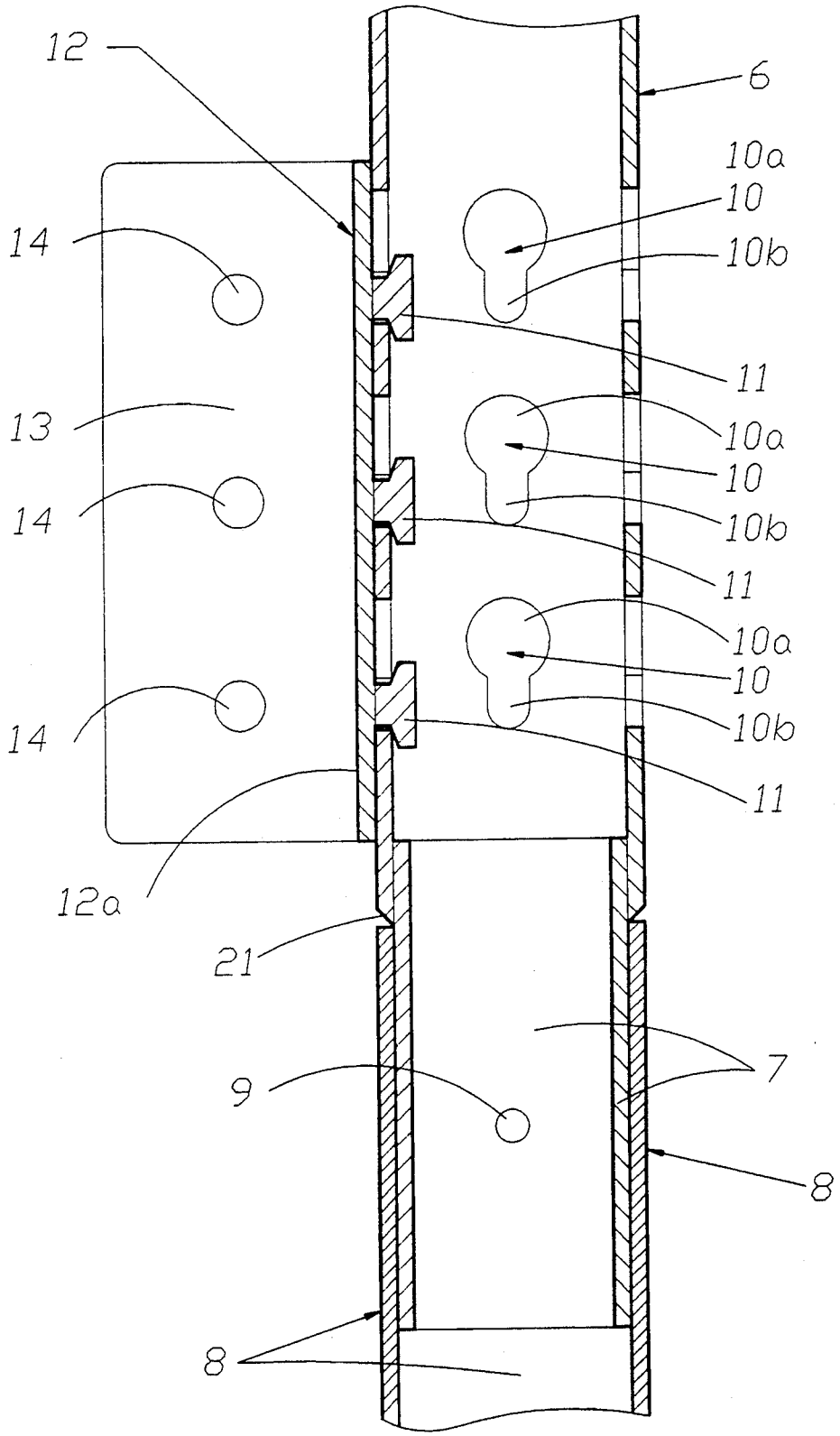
FIG. 5 is a vertical cross-sectional partial view of the typical bracket to tubular connector device of the invention fully assembled prior to connection of the beam components.

FIG. 5 further illustrates the aligned bolt holes 14 in beam bracket flange 13 equally spaced vertically in alignment with studs 11 and the engagement slot 10b of the key-holes 10. Post connecting sleeve 7 is further shown in partial section view set within the inner wall of tube 6 and preferably welded structurally to it, for example along the canted line 21.

Figure 6:
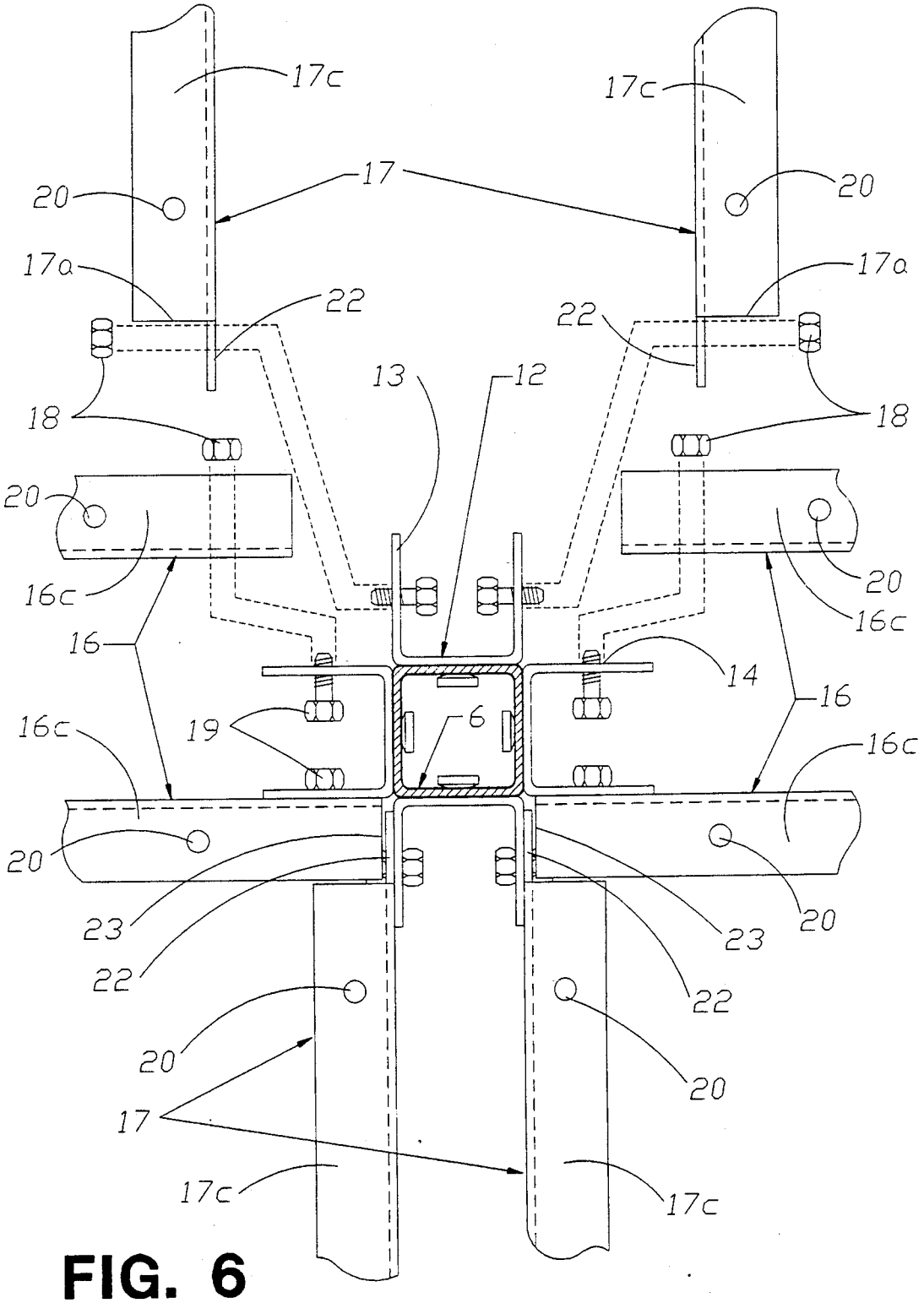
FIG. 6 is a partially exploded view taken along lines 6—6 of FIG. 4, and in section through the connector device illustrating the positioning of end beams and tie beams at the interior post of a completed framework.

FIG. 6 illustrates all of the elements of the invention previously identified in FIGS. 3, 4 and 5, but from a partial section view through the post downward showing both the preengaged (in the upper half of the drawing) and the engaged post positions at location 1c as shown in diagram FIG. 2. As seen therein all elements of a completed framework assembly at the FIG. 6 post location are symmetrical about each plan view centerline of the connection tube 6. Further illustrated is beam 17 with protruding flange 22 at cut outs 17a shown preengaged and shown engaged in position at right angle contact with the end of beam flange 16c at 23. Equally possible is an arrangement not shown whereby the fixed 90° opposite positioning of beam 16 to beam 17 is interchanged at all or any one of the four beam right angle intersections. This notched positioning of beam 17 to beam 16 in the present invention fixes the two beam types in always 90° opposite relationship in any orthogonal framework assembly.

Figure 7:
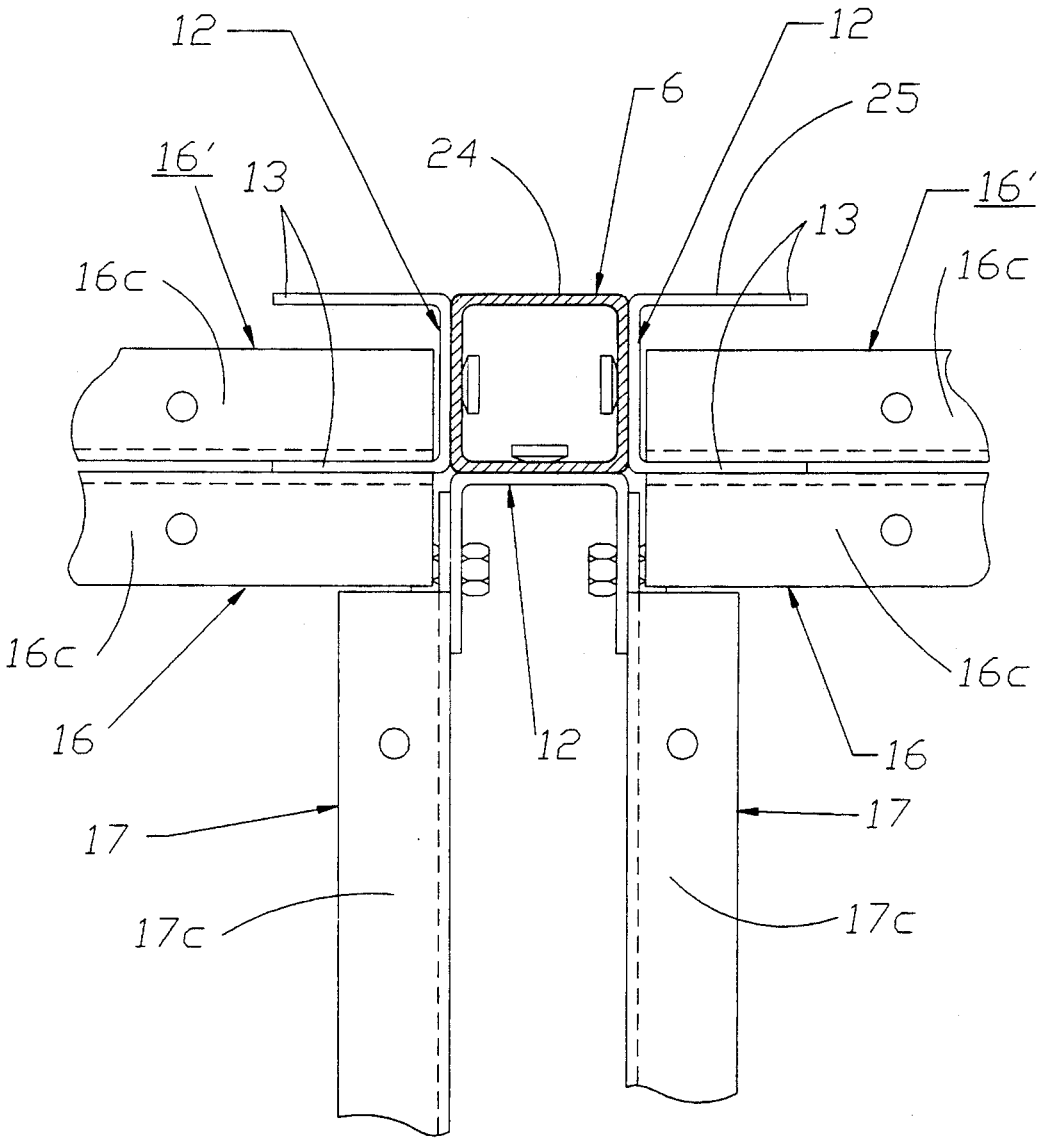
FIG. 7 is a plan view similar to FIG. 6 but showing a post at the perimeter of a completed framework with beams positioned prior to receiving both horizontal and vertical infill panels.

FIG. 7 is a view similar to FIG. 6, except three brackets 12 are a attached to connecting tube 6, reflecting the basic diagram plan of a perimeter post at location 1b shown diagram FIG. 2. As seen in FIG. 7, beam 16 is positioned in bolted engagement with bracket flange 13 and parallel to a beam 16' at the opposite side of the flange. In this location key-holes 24 and bolt holes 25 on the outside face of tube 6 are left unoccupied, but available for bracket and or beam attachment should the framework be expanded. Beam 16' is in position to support vertically disposed infill means such as wall panels at the perimeter of the framework.

FIG. 8 is a sectional view through beams 16 or 17 and a pre-positioned floor or roof infill panel 27. The panel type infill means in the present embodiment is shown composed of common lightgauge metal channel section 28, with a stress skin 27, usually plywood, shown in fixed attachment to the top face or flange of channel 28, and with bolt holes 30 predrilled for alignment with beam holes 20. It is understood that varying infill panel or common framing means can be used for connection to beam elements 16 and 17. In the preferred embodiment a suitable insulation material 29 may or may not be used to fill the cavity bounded between panel rim-joists 28, the underside of plywood panel skin 27, and the bottom edge frame 28a of the panel.

Figure 9:
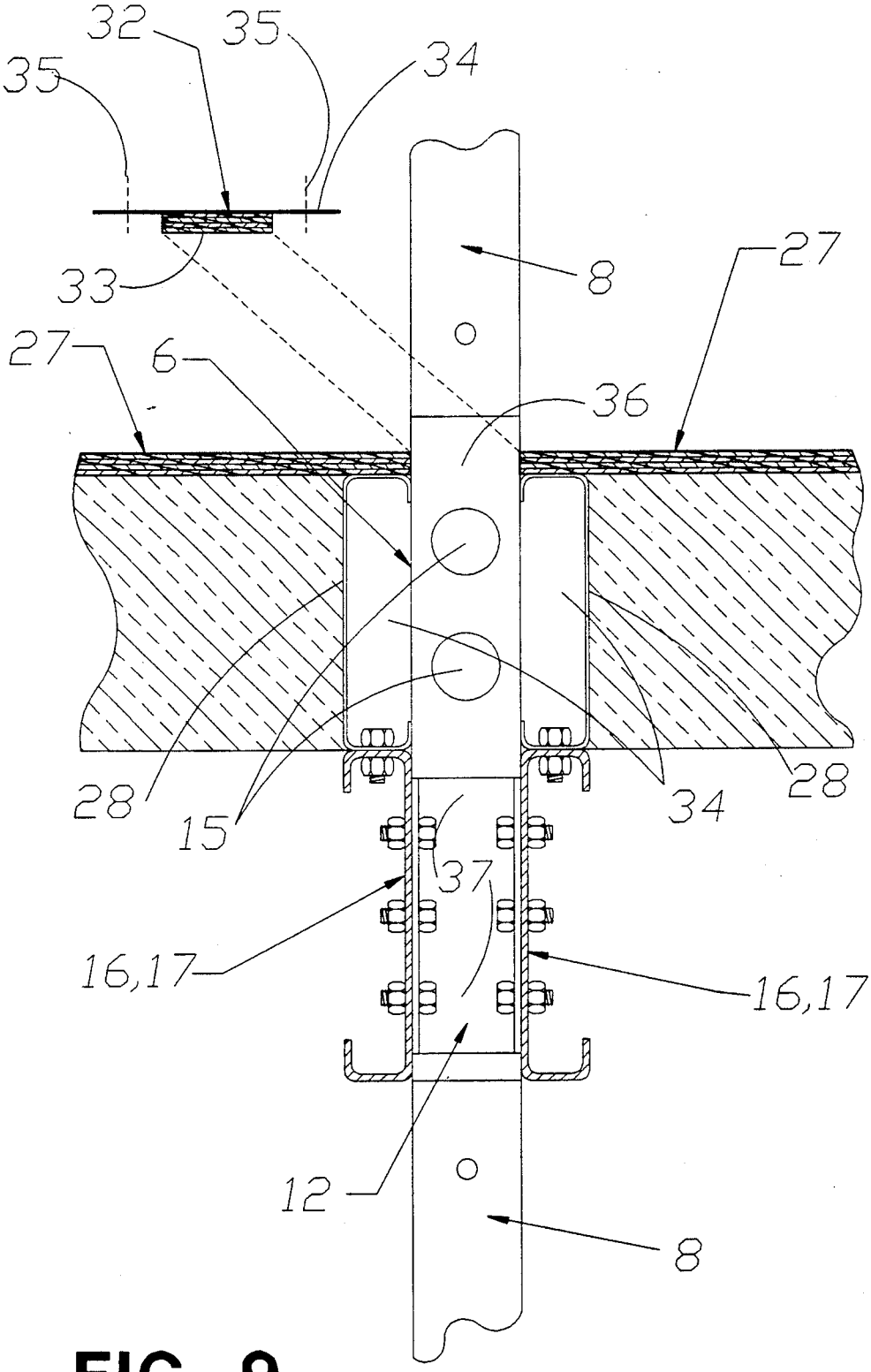
FIG. 9 is a view similar to FIG. a illustrating the completed positioning of floor panels to beams and beams to connecting device, and illustrating the preferred means of closing the space between the double beams.

FIG. 9 shows the same elements as shown in FIG. 8 in fully assembled relationship with a closure piece 32 in pre-assembled section view. Closure piece 32 in the preferred embodiment of the present invention is typically a strip of plywood 33 of a length equal to the distance apart of posts 8 measured to the post face and the width of the gap 36 between infill panels 27. A continuous or semi-continuous thin-gauge sheet-metal strap 34 is affixed by common nail or staple and adhesive or other suitable common means to the plywood strip 33 so that the metal strap is wider than the plywood strip and when positioned against panel skin 27 at gap 36 it is fastened by usual screw-type means 35 in position (shown in FIG. 10) . The closure piece acts to laterally tie the adjacent infill panels 27 together and thereby structurally bridge the gap 36 and achieve a continuous flat usable floor or roof surface.

As seen in FIG. 9 when panels 27 and closure piece 32 are positioned in place mechanical chases or raceways 34 are established by opposite facing channel rim joists 28 for horizontally locating wire tubes or pipes normally associated with building construction services, such as power feeds, telephone cable, water supply and other similar utility lines (not shown) . Further, the gap 37 between dual beams 16 or 17 provides for the introduction of the same building service means; and cavities 34 are contiguous with cavity 37. As will be apparent cavities 34 communicate horizontally throughout the enclosed framework of any size and these same raceways communicate vertically upwards or downwards by means of round holes 15 in each face of the hollow square tube connecting device 6 shown first in FIG. 3. Variations of closure piece 32, not shown, but obviously derived are flip-up, pop-up, hinged trap door type, or common screw release means to allow for convenient access to service elements routed in the raceways 34.

Figure 10:
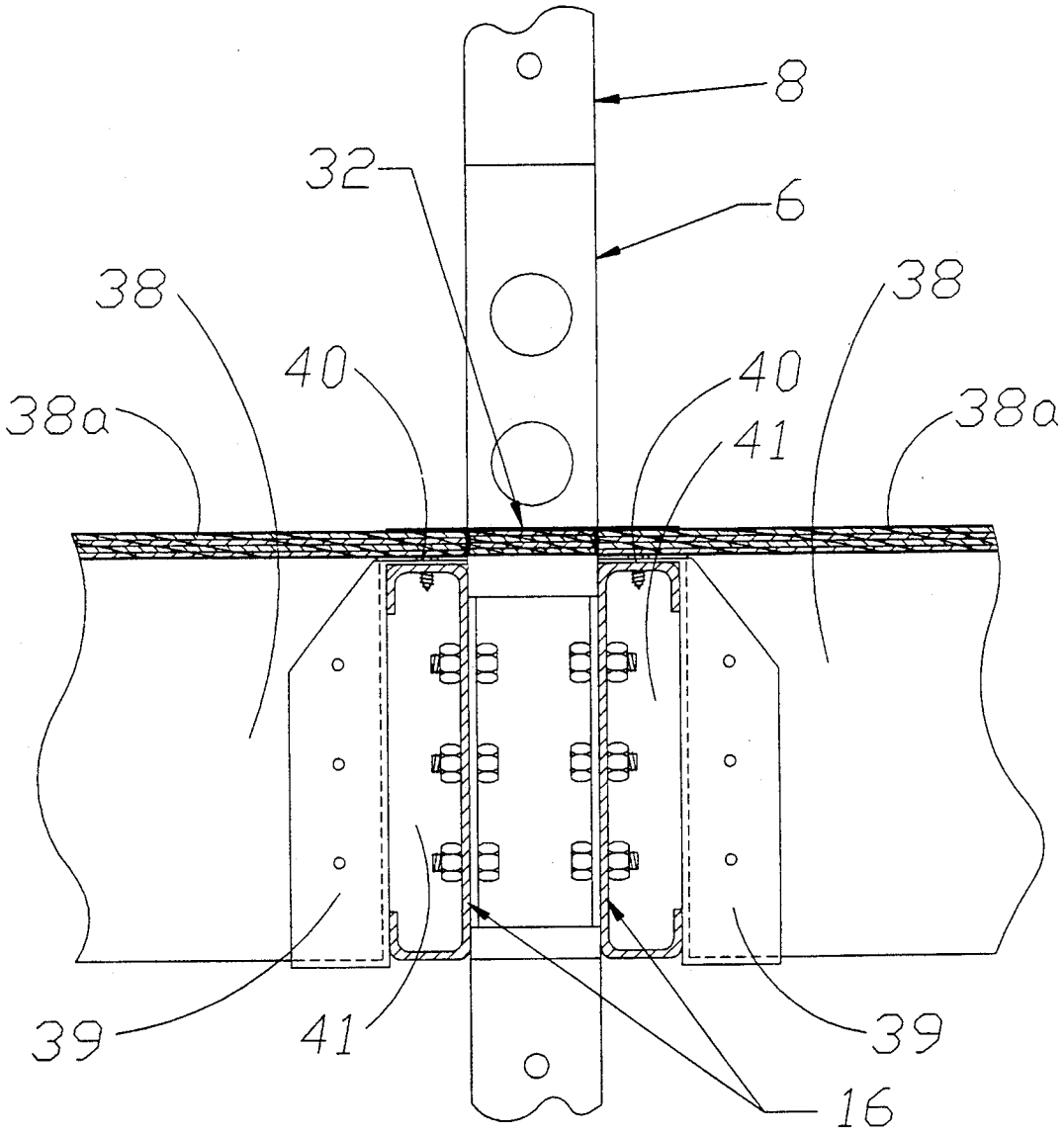
FIG. 10 is a view similar to FIG. 8 illustrating a variation of the typical panel components with the substitution of common wood framing and common joist hanging device.
Figure 10A:
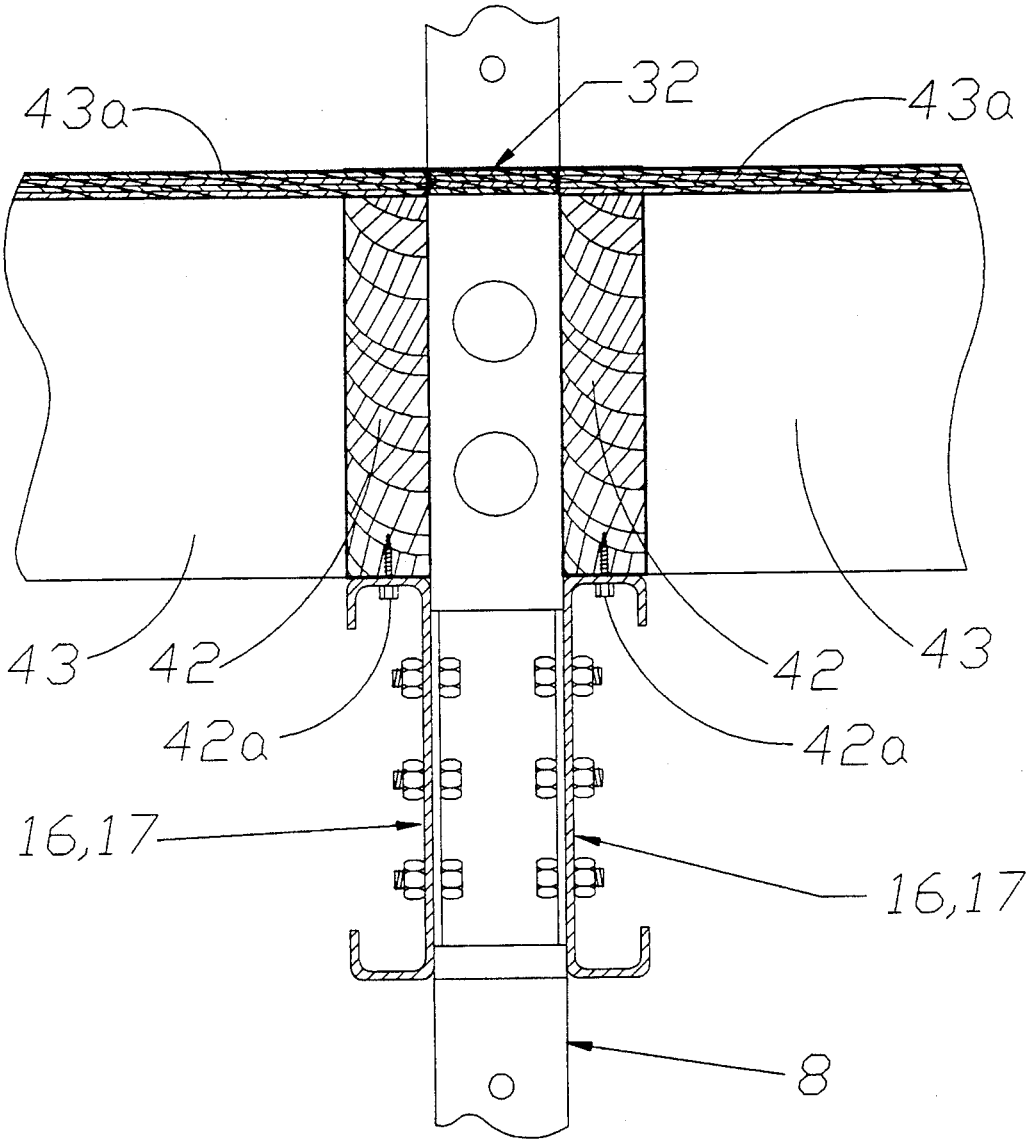
FIG. 10A is similar to FIGS. 9 and 10 illustrating another variation of the typical panel elements with the substitution of common wood floor and/or roof framing fastened on the top flange of the preferred steel beam arrangement.

FIGS. 10 and 10A differ from FIG. 9 by replacing infill panel type elements with common wood framing members 38 such as 2×8s, 2×10s or 2×12s and with common plywood skins 38a attached thereto.

In FIG. 10 the secondary infill framing members 38 are supported by commonly available metal joist hangers 39 secured by common screw means 40 at the top flange of the beams 16. This alternate configuration provides a cavity or raceway at position 41. FIG. 10A illustrates another variation on floor or flat roof panel infill means from that shown in FIG. 9, with common wood framing member rim joists 42, joists 43 and plywood skin means 43a secured to the top flange of beams 16/17 by common screw means 42a.

FIGS. 10 and 10A illustrate another flexible quality of the present framework method and devices therein, whereby premanufactured steel elements suitably prepared can be used in conjunction with common wood framing means.

PIGS. 11 and 12 illustrate similarly in partial section view the elements of the framework with infill element floor or roof panel 27 and with a perimeter wall panel 44 which occurs at the exterior typical perimeter post location 1*a* or 1*b* (FIG. 2). Wall panels 44 are positioned above and below beam 16' are of similar construction as the floor/roof panels, with common plywood sheathing 44*a* fixed to common lightgauge steel framing 44*b* and any variety of common insulation means 44*c* shown as hatched lines.

Figure 11:
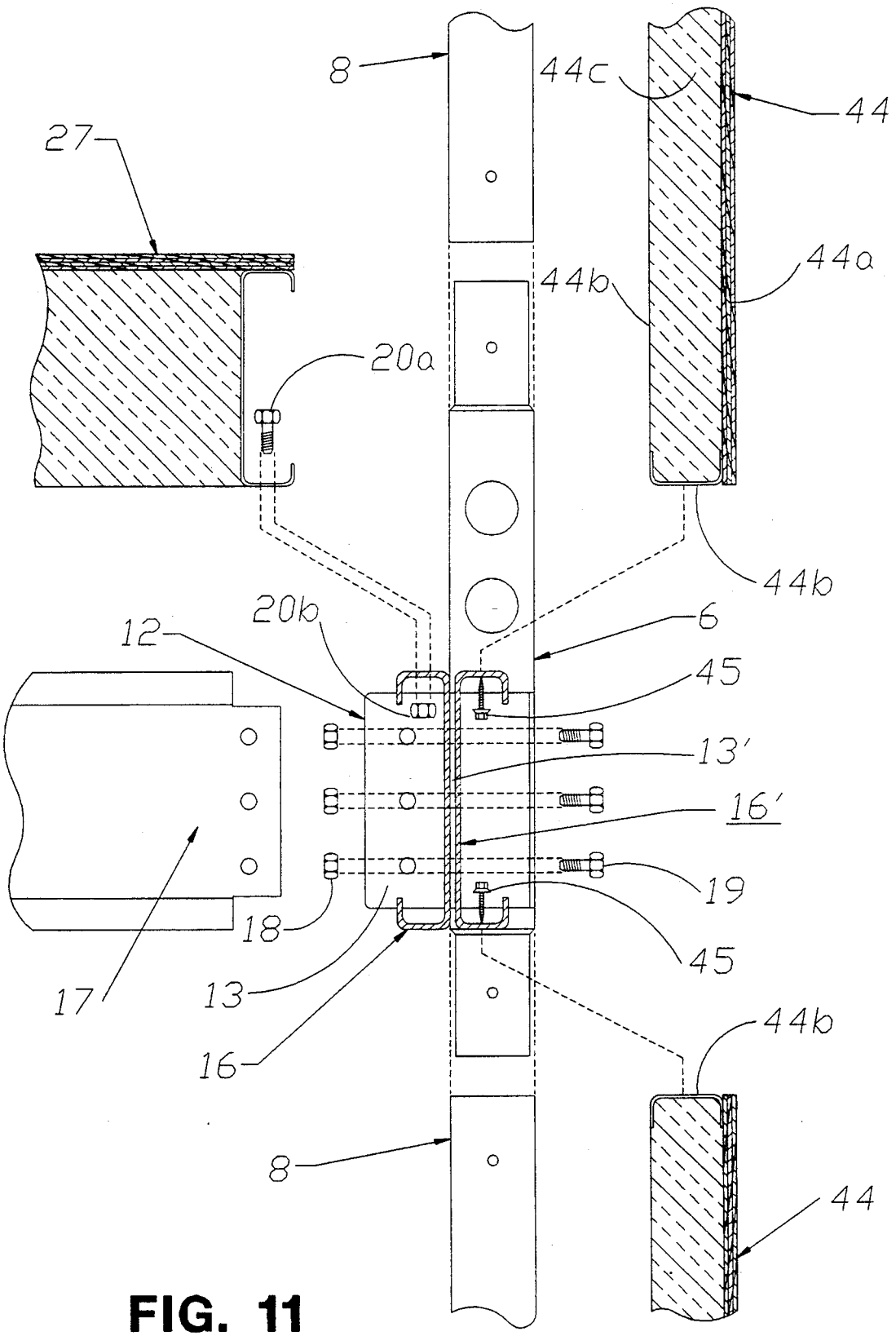
FIG. 11 is a view similar to PIGS. 8, 9, and 10 illustrating the condition at the perimeter of a typical framework where the wall and floor panel components are shown prior to final positioning.
Figure 12:
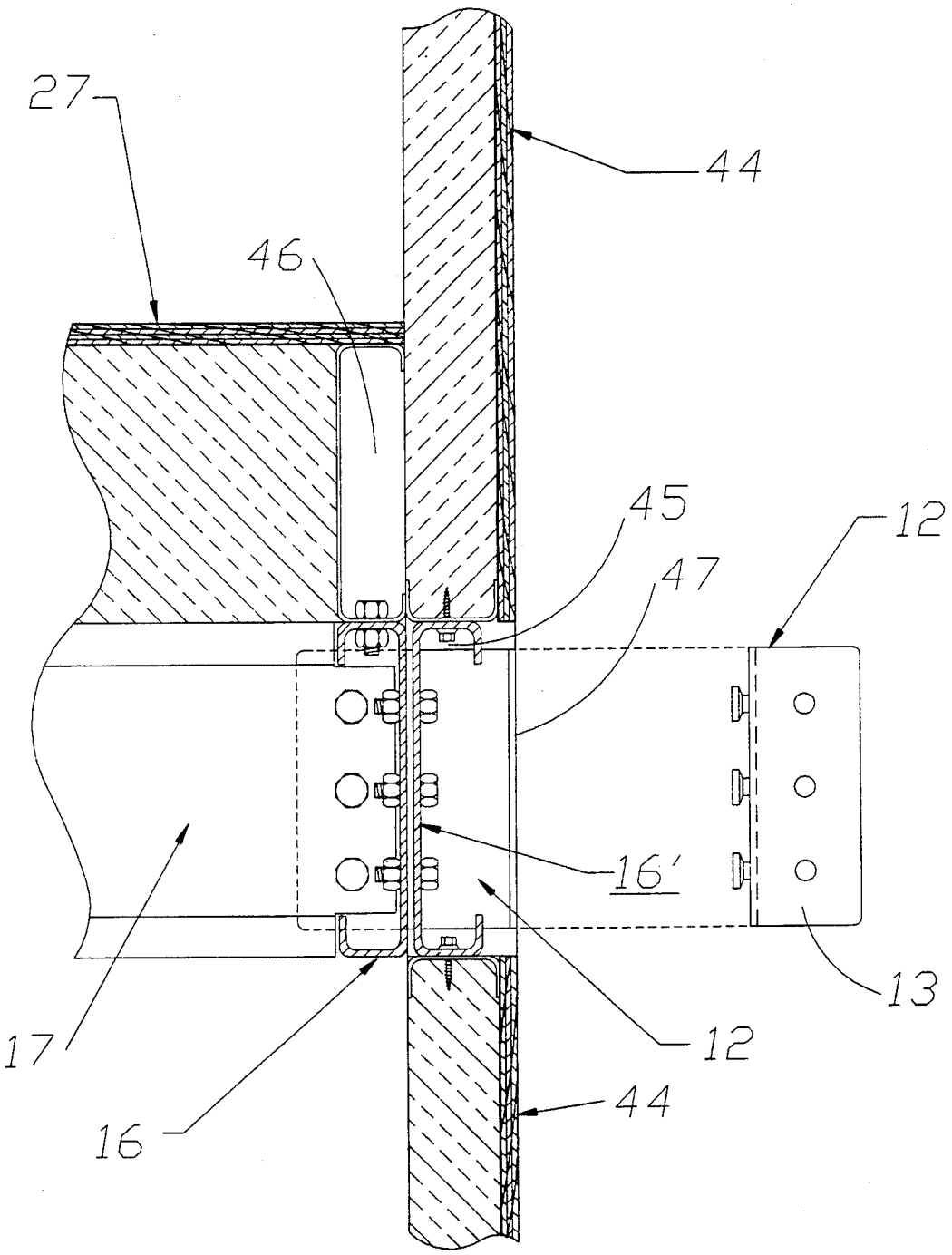
FIG. 12 is a view similar to FIG. 11 illustrating the final position of floor and wall enclosure elements.

As shown in FIGS. 11 and 12 beam 17 is bolted to the facing bracket 12 along flange 13, at 90° to beam 16. Wall panel 44 is positioned above beam 16' which is in back-to-back aligned relationship to beam 16 bolted therewith to a shared bracket flange 13'.

FIGS. 11 and 12 also show bolts 20*a* and nuts 20*b* used to secure roof/floor panel means 27 in closed 90° adjacency to wall panel means 44. The latter is fixed in position with common screws 45. This cooperation forms a cavity raceway 46, which of course is in horizontal communication throughout an entire framework of any size enclosed with similar panel infill elements, including raceway 34 shown in FIG. 9.

It is intended that the cavity 46 at the building perimeter in the present embodiment, after final assembly and utility lines are installed, be filled with a common expanding foam type insulation creating a continuous insulation barrier at the 90° intersection of floor and wall panels. The region of insulation means shown by cross-hatching in FIG. 12 in conjunction with a field applied insulated cavity 46 is an unusually effective thermal insulation barrier with minimum thermal breaking cross-section area interruption.

Figure 12A:
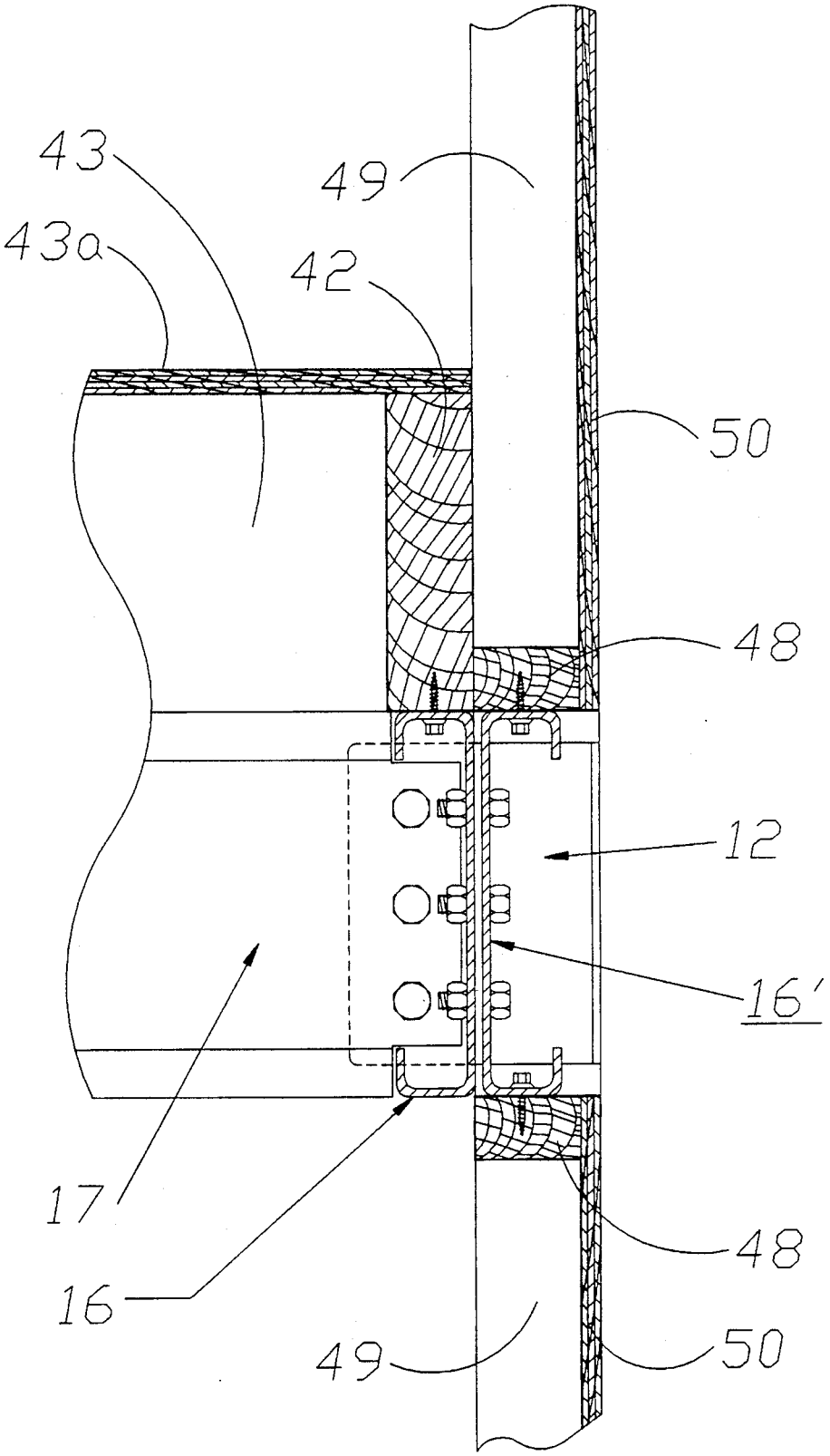
FIG. 12A is a view similar to FIG. 12 illustrating floor or roof framing elements in conjunction with common 2×4 type wood wall construction.

FIG. 12A illustrates an optional embodiment in association with wood joist frames 42, 43, 43*a* positioning shown previously in FIG. 10A, whereby vertical wall infill elements are composed of common wood framing elements including a common wood sill plate 48 connected by common nailing means to wood studs 49 and similarly sheathed with common plywood 50.

Figure 13:
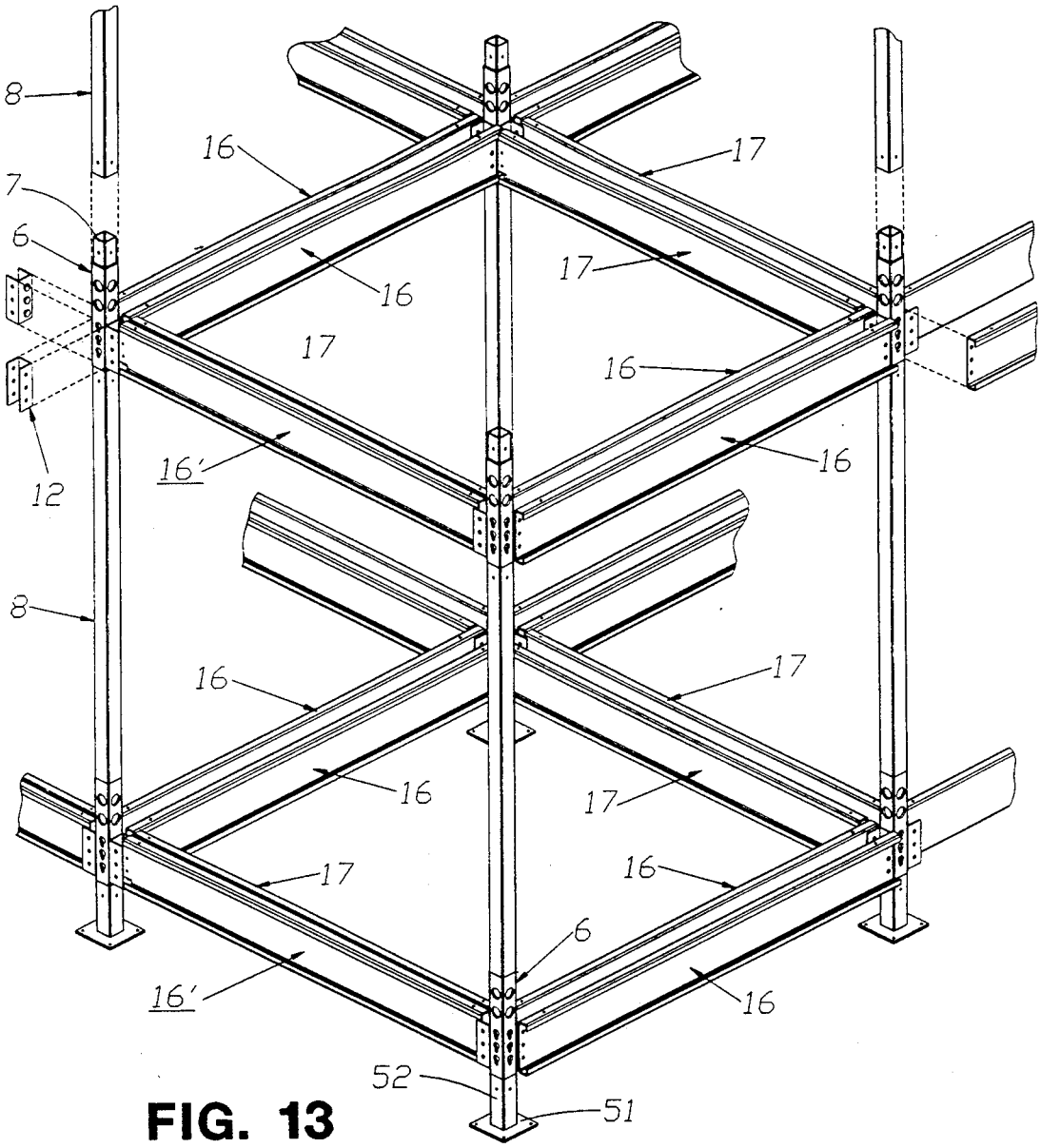
FIG. 13 is an isometric view of a portion of a building frame with bracket to connector device and beams typically assembled according to the present invention.

An assembly of each major element of the preferred framework is shown in isometric view FIG. 13, these include a connecting shaft 6, shaft splice 7, post 8, bracket 12, beam type 16, beam type 17, and perimeter wall ledger beam 16'. FIG. 13 further shows a steel base plate 51 welded to the lower post tube 52 which is connected to the post-to-beam connecting shafts 6 by typical sleeve 7 connection in conjunction with the base plate assembly. The base plate assembly for foundation anchoring is not critical to the present invention, since a multitude of obvious and common framework-to-foundation anchoring means are available and could be used.

Figure 14:
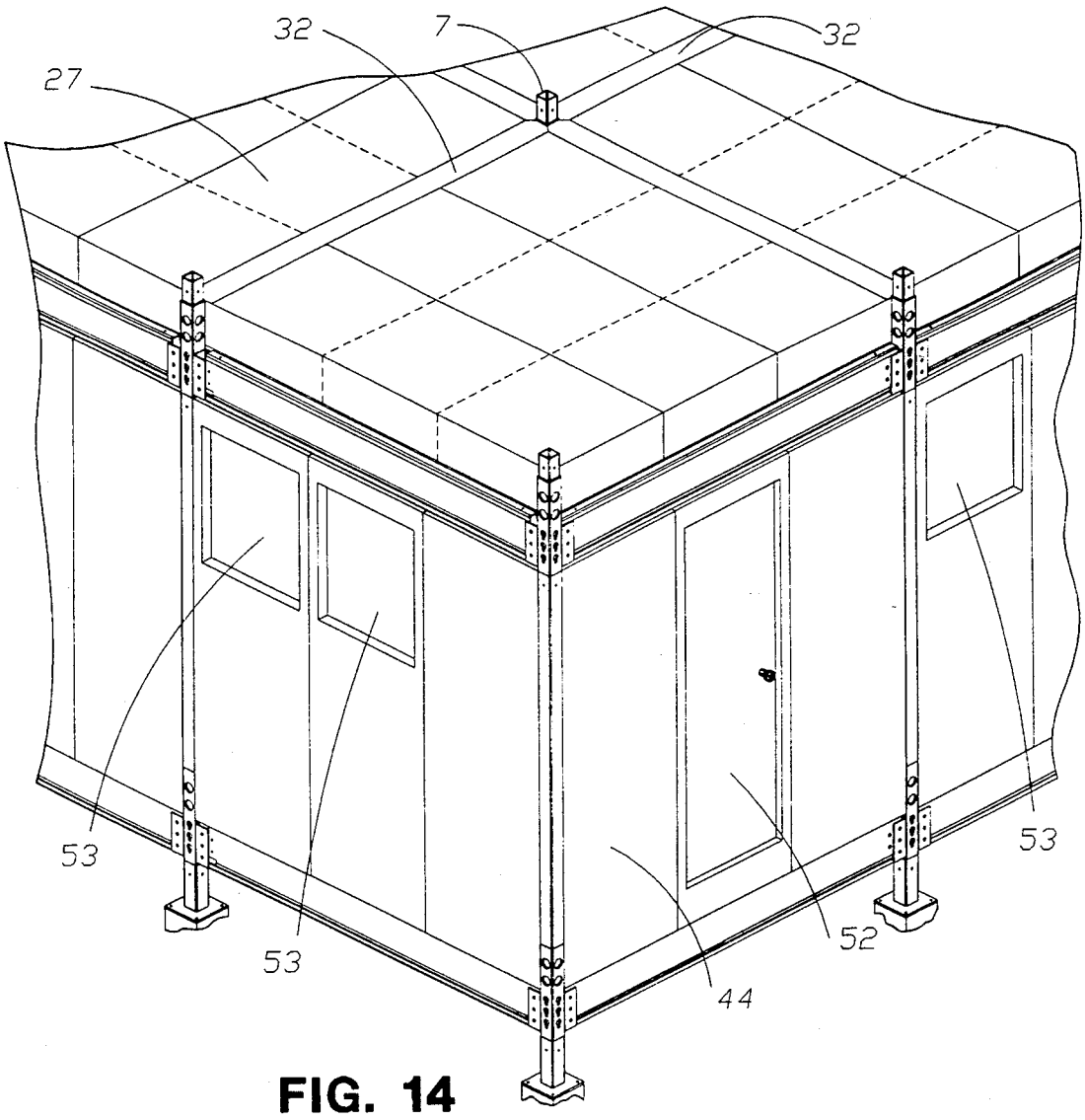
FIG. 14 is an isometric view of a portion of a building frame showing the fully assembled framework with infill panels indicated in place.

FIG. 14 illustrates a portion of an assembled framework with perimeter wall and floor infill panel means and closure strip 32 in position. For clarification wall panels are illustrated with typical building items including door 52 and windows 53 incorporated in the arrangement of panels. It is understood, however, that the location and, size of these and other typical building items are interchangeable with any other panel of equal dimension elsewhere on the framework.

In FIG. 14 sleeves 7 of the connecting device 6 of the present invention are in position to receive additional components of the framework for additional levels, or in position to accommodate an assortment of roof constructions, such as parapets or sloped roof elements, not presently part of the invention.

Figures 15A, 15B, 15C, 15D, 15E:
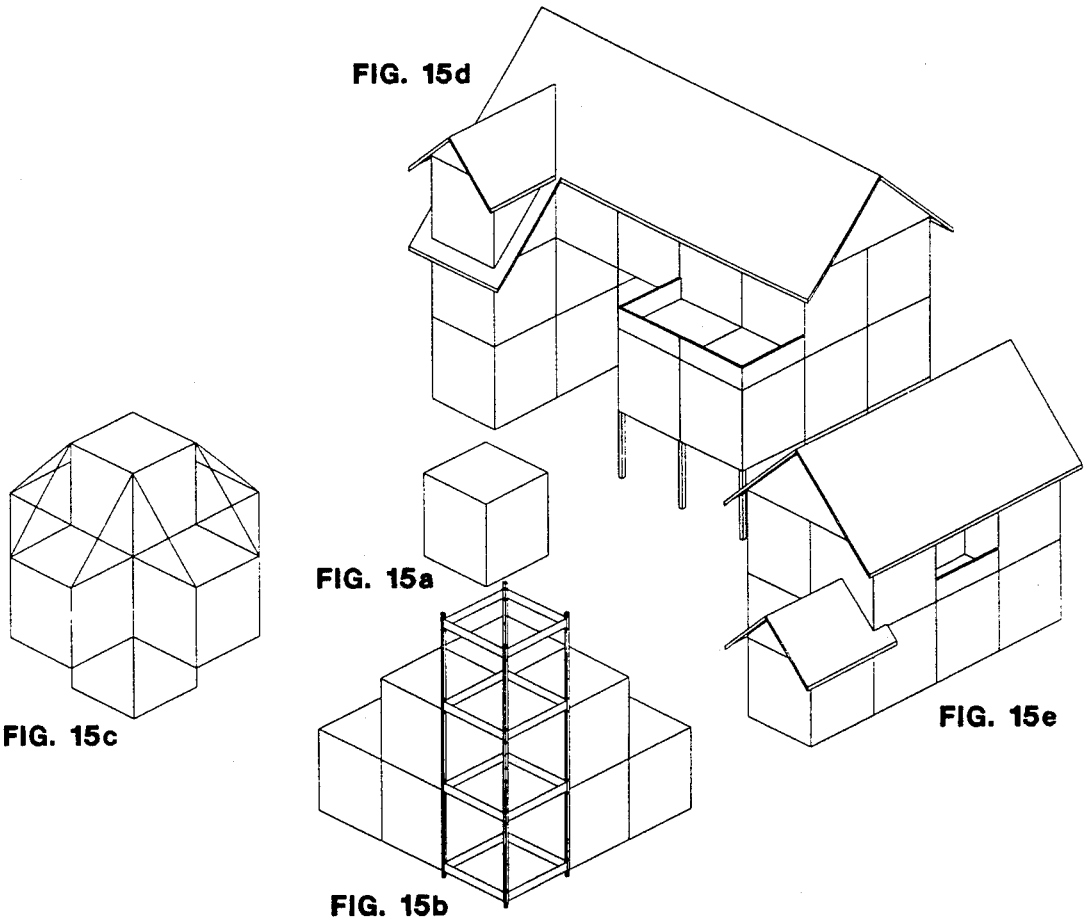
FIGS. 15 *a, b, c, d* and *e* are isometric views illustrating several variations of the present embodiment in juxtaposition from single framework to fully combined building frameworks which are large enough to comprise a variety of generally recognizable building forms.

The inherent capability of the elements of the preferred embodiment of the present invention to generate any variety of basically orthogonal building shapes and sizes is illustrated in FIGS. 15 *a-e*. The flexibility implied by the building shapes illustrated in FIG. 15 to generate custom designed buildings using like elements is an essential characteristic of the invention.

Although the invention has been described in connection with the illustrative embodiments, it will be understood by those skilled in the art that the invention is not limited to those precise embodiments, but that various changes and modifications may be effected therein by those skilled in the art without departing from the scope or spirit of the invention.

What is claimed is:

1. An orthogonal framework comprising a hollow square connecting tube, means in the end of said connecting tube for connecting hollow square posts to the connecting tube in vertical alignment with each other; a U-shaped bracket including means for removably connecting the bracket to the connecting tube, and at least one pair of beams connected to said bracket; said bracket having vertically and outwardly extending flanges located to be in vertical alignment with the orthogonally adjacent faces of said connecting tube and said beams being C shaped in cross section and separately respectively connected to the flanges of the bracket, each beam having a vertical web including a flat inner face secured to an associated one of said flanges whereby said flat inner faces of the beams are aligned with the adjacent faces of the connecting tube.

2. An orthogonal framework including a hollow connecting tube which is generally square in cross-section; a pair of vertically aligned square hollow posts whose peripheral cross-section dimensions are substantially the same as that of said tube; means for connecting said posts to said tube in vertical alignment with the surfaces of the tube and posts being generally aligned; at least one U-shaped bracket; means for removably securing said bracket to one side of said tube, said bracket having a pair of vertically and outwardly extending flanges having outer surfaces respectively aligned with the surfaces of the sides of the tube that are adjacent to and extend perpendicularly from the side of the tube to which the bracket is attached; and a pair of C shaped beams respectively secured to said flanges, said beams each having a vertical web, each web having an inner face and a pair of spaced beam flanges extending away from the web on the side thereof opposite its inner face, the inner face of one web facing the inner face of the other web and positioned only against the outer surfaces of said bracket flanges whereby the inner surfaces of said beams align with the surfaces of said tube.

3. An orthogonal framework as defined in claim 2 wherein said means for connecting said posts to said tube comprise square extension sleeves secured in opposite ends of said tube and having an external peripheral dimension in cross-section which is complimentary to the internal cross-section of said posts to slidably fit therein.

4. An orthogonal framework as defined in claim 2 wherein said means for removably securing the bracket to the tube comprise a plurality of keyhole slots formed in said tube and headed studs secured to the bight of said bracket and dimensioned to fit in said keyhole slots.

5. An orthogonal framework as defined in claim 2 wherein said C-shaped beams have flanges facing away from said flanges of the bracket.

6. An orthogonal framework as defined in claim 2 including a decking module connected to at least one of said beams, said module including a C-shaped beam including a web and flanges extending therefrom, said beam of the decking module being connected above and to one of said framework beams with its web spaced from the post and the flanges thereof extending towards the post, thereby to define a raceway for electric wires, pipes or the like.

7. An orthogonal framework as defined in claim 2 wherein said tubes have access holes formed therein above the connection to said bracket whereby said tube and posts define a mechanical chase.

8. An orthogonal framework as defined in claim 2 including a plurality of U-shaped brackets mounted on said tube.

9. An orthogonal framework including a hollow connecting tube which is generally square in cross-section; a pair of vertically aligned square hollow posts whose peripheral cross-sectional dimensions are substantially the same as that of said tube; a pair of tubular extension sleeve elements connected to said tube and extending from opposite ends thereof, said extension tubes having an external peripheral dimension in cross-section which is complimentary to the internal cross-section of said posts to slidably fit therein; a plurality of U-shaped brackets respectively associated with the sides of said tube, said brackets each having a bight portion and a pair of flanges extending therefrom; means for removably securing said brackets to their associated side of said tube; said flanges having outer surfaces and being spaced from one another a predetermined distance such that said outer surfaces are aligned with the surfaces of the sides of the tube that are adjacent the side to which their bracket is attached; and a plurality of C shaped beams respectively secured to at least some of said flanges; said beams each having a web and a inner face positioned only against the outer surface of its associated bracket flange whereby the inner faces of said beams align with the surface of the sides of said tube.

10. An orthogonal framework as defined in claim 9 wherein said means for removably securing the bracket to the tube comprises a plurality of keyhole slots formed in each side of said tube and headed studs secured to the bight of each bracket and dimensioned to fit in said keyhole slots.

11. An orthogonal framework as defined in claim 10 wherein said keyhole slots are aligned along the axis of said tube on each side thereof.

12. An orthogonal framework as defined in claim 10 wherein said C-shaped beams have flanges facing away from said flanges of the bracket.

13. An orthogonal framework as defined in claim 12 including a decking module connected to at least one of said beams, said module including a C-shaped beam including a web and flanges extending therefrom, said beam of the decking module being connected above and to one of said framework beams with its web spaced form the post and the flanges thereof extending towards the post, thereby to define a raceway for electric coils, pipes or the like.

14. An orthogonal framework as defined in claim 13 wherein said tubes have access holes formed therein above the connection to said bracket whereby said tube ana posts define a mechanical chase.

15. A connecting device for use in a modular frame work comprising means for connecting first and second vertically aligned hollow posts to each other and U-shaped bracket means removably secured to the connecting means for separately and independently supporting floor load support beams and wall load support beams, said bracket means having outwardly extending flanges, said connecting means being orthogonal in plan and said bracket means and beams being arranged such that the flanges of the bracket means are in vertical alignment with adjacent sides of the connecting means and the interior faces of said beams align with the adjacent sides of the connecting means, said bracket means being removable from said connecting means when the connecting means is connected to said first and second hollow posts.

* * * * *